US005774908A

United States Patent [19]

Hall

[11] Patent Number: 5,774,908

[45] Date of Patent: Jul. 7, 1998

[54] OUTDOOR SHOWER AND ACCESSORY HOLDER

[75] Inventor: Charles P. Hall, Santa Rosa, Calif.

[73] Assignee: Stearns, Incorporated, Santa Rosa, Calif.

[21] Appl. No.: 714,331

[22] Filed: Sep. 18, 1996

[51] Int. Cl.[6] ..... H47K 3/22

[52] U.S. Cl. ..... 4/617; 4/602

[58] Field of Search ..... 4/598, 599, 600, 4/602, 603, 605, 616, 617; 224/683, 684; 383/38–41

[56] References Cited

U.S. PATENT DOCUMENTS

| | | | |
|---|---|---|---|
| 1,330,312 | 2/1920 | Figueroa | 4/602 X |
| 1,560,442 | 11/1925 | Trowbridge | 383/40 X |
| 2,540,411 | 2/1951 | Wright | 4/599 X |
| 3,590,398 | 7/1971 | Jetter | 4/599 |
| 4,280,643 | 7/1981 | Cordova et al. | 4/602 X |
| 4,520,793 | 6/1985 | Hall . | |
| 5,515,558 | 5/1996 | Dodge | 383/40 X |

*Primary Examiner*—Charles E. Phillips

*Attorney, Agent, or Firm*—Flehr Hohbach Test Albritton and Herbert LLP

[57] ABSTRACT

Outdoor shower and accessory holder of flexible plastic construction with a chamber for holding water to be heated by solar energy, and a plurality of pockets for holding accessory items for use by a bather.

10 Claims, 3 Drawing Sheets

OUTDOOR SHOWER AND ACCESSORY HOLDER

This invention pertains generally to equipment for use by outdoorsmen and, more particularly, to a solar heated shower and accessory holder.

One example of a solar heated shower which can be used by boaters, backpackers, campers and the like is found in U.S. Pat. No. 4,520,793. That shower comprises a flexible plastic bag with a spray hose for spraying water from the bag onto a bather. The bag can hold about two gallons of water and is fabricated of materials which enhance the transfer of solar energy to the water.

In use, a solar heated showers are commonly hung from tree limbs or other supports, with no place for a bather to put toiletries and other accessories, e.g., soap, shampoo, razors, shaving cream, and the like.

It is in general an object of the invention to provide a new and improved outdoor shower and accessory holder.

Another object of the invention is to provide an outdoor shower and accessory holder of the above character which overcomes the limitations and disadvantages of solar heated showers of the prior art.

These and other objects are achieved in accordance with the invention by providing an outdoor shower and accessory holder of flexible plastic construction with a chamber for holding water to be heated by solar energy, and a plurality of pockets for holding accessory items for use by a bather.

Figure 1:
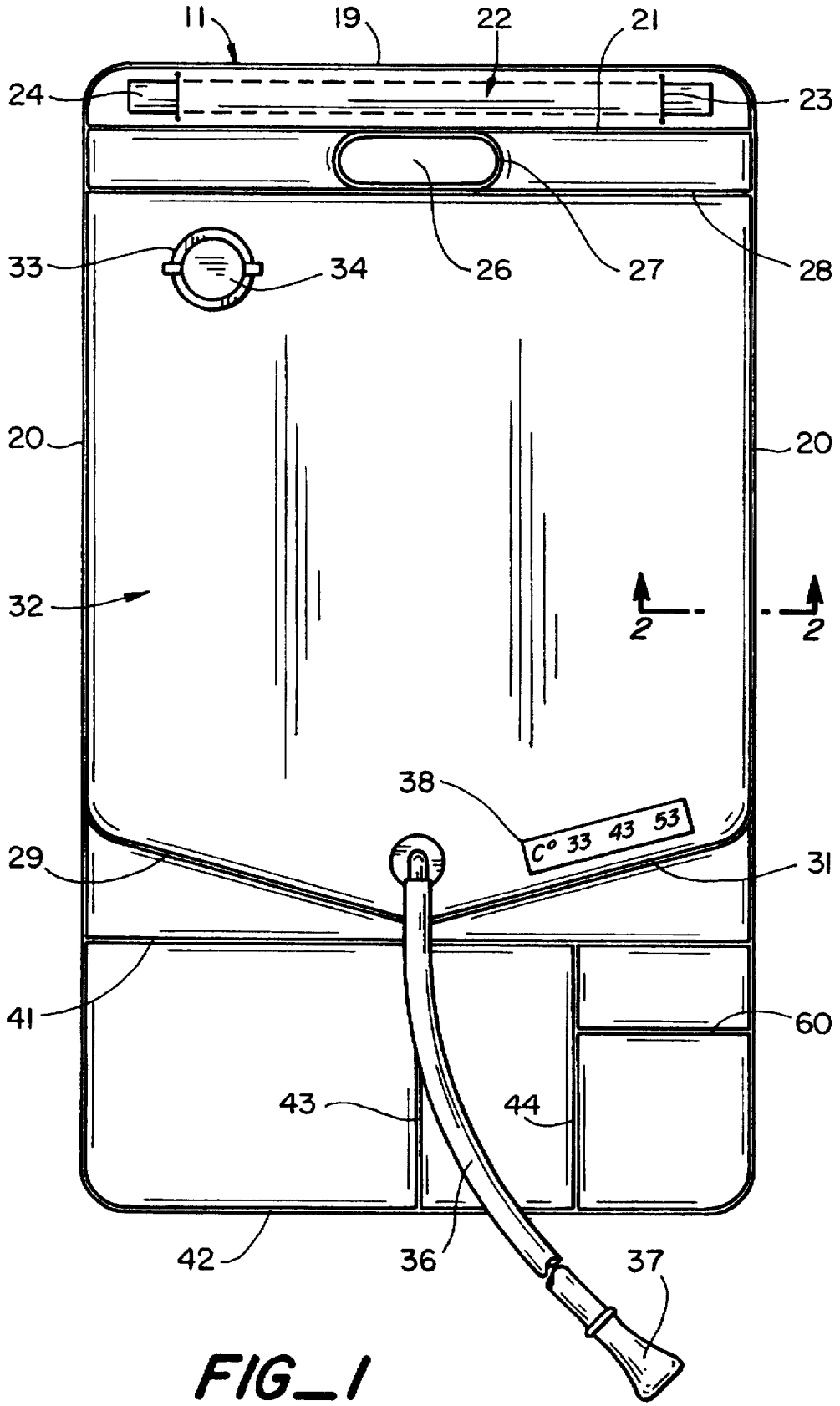
FIG. 1 is a front elevational view of one embodiment of an outdoor shower and accessory holder according to the invention.
Figure 2:
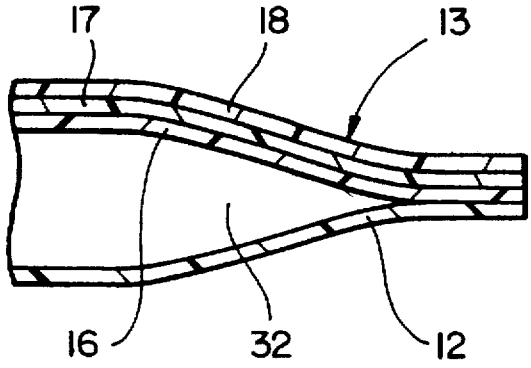
FIG. 2 is a fragmentary cross-sectional view taken along line 2—2 in FIG. 1.
Figure 3:
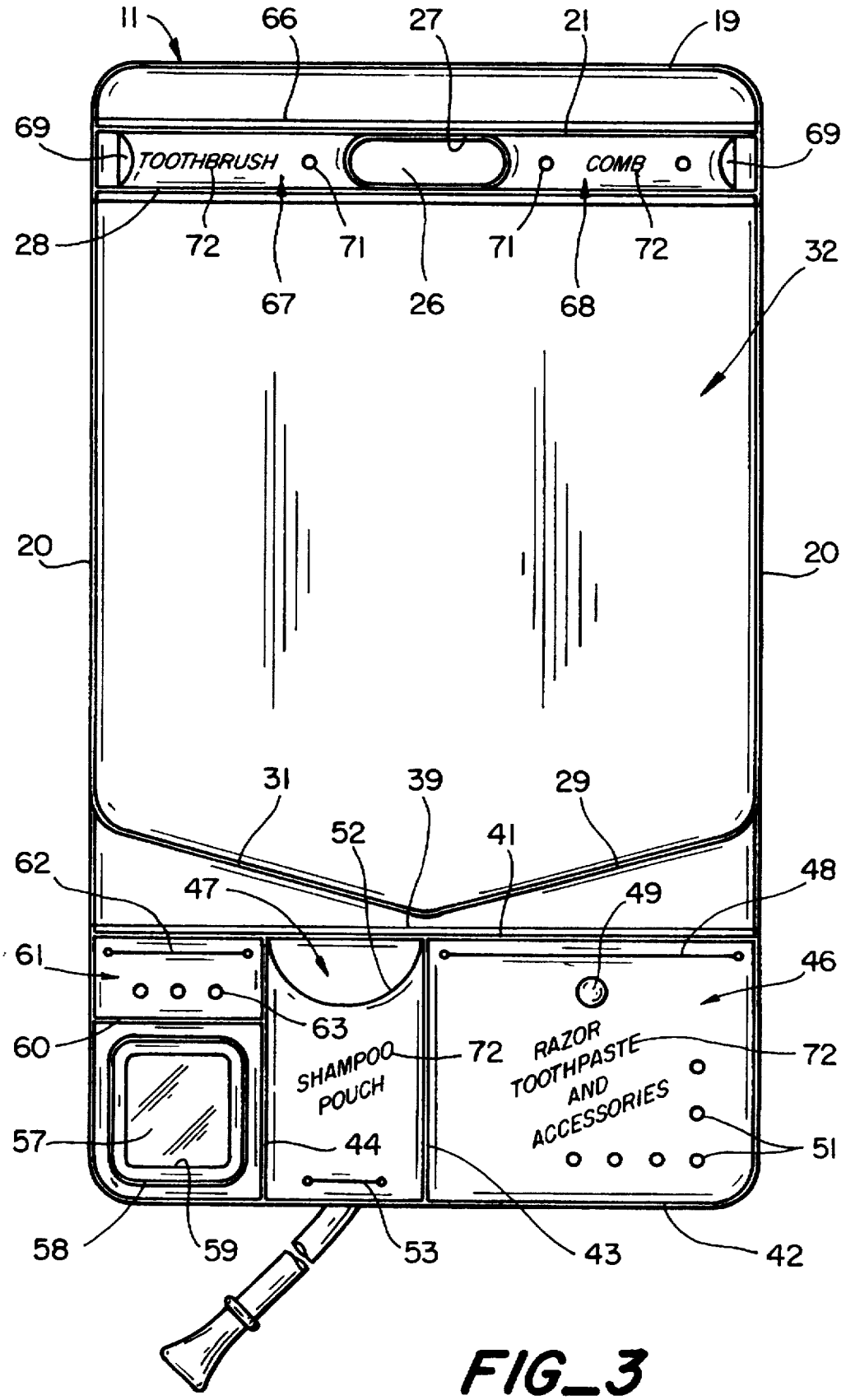
FIG. 3 is rear elevational view of the embodiment of FIG. 1.

As illustrated in FIGS. 1–3, the shower and accessory holder has a generally rectangular body 11 formed by two superposed sheets or panels 12, 13 of flexible plastic material. In one presently preferred embodiment, front panel 12 is a single sheet of transparent polyvinyl chloride (PVC) having a thickness on the order of 15–20 mils, and rear panel 13 is a three layer laminate, as described in U.S. Pat. No. 4,520,793, the disclosure of which is incorporated herein by reference. The laminate includes a front layer of darkly colored (e.g., black) PCV 16, a middle layer of insulative material 17 (e.g., a polymeric foam such as polyurethane or polyethylene), and a rear layer of reflective material 18 such as a metallic colored PVC (e.g., gold or silver colored PVC).

The two panels are sealed together along their top and side margins 19, 20 by suitable means such as ultrasonic welding. They are also sealed together along a line 21 spaced a short distance (e.g., 1½ inches) below the upper margins of the panels to form a horizontally extending pocket 22 between the panels. Access to that pocket is provided by a pair of vertically extending cuts 23 in panel 12 near the ends of the pocket. A rigid tubular handle 24 is disposed in the pocket and extends substantially the entire width of the panels. If desired, a rope (not shown) can be passed through the handle for use in hanging the shower from a tree branch or other support.

An opening 26 is formed in the panels beneath the pocket to receive the fingers of a hand gripping the handle. The two panels are sealed together about the periphery of the opening, as indicated at 27.

The panels are sealed together along a horizontally extending line 28 beneath the handhold opening and along a pair of downwardly and inwardly inclined lines 29, 31, to form a chevron-shaped chamber 32 for holding water to be heated. Panel 12 terminates immediately below weld lines 29, 31. An inlet fitting 33 having a removable plug or cap 34 is mounted on panel 12 in an upper corner of the chamber near weld line 28 for introducing water into the chamber. An outlet hose 36 is connected to the panel just above the junction of weld lines 29, 31 in communication with the lower portion of the chamber. A spray head 37 is connected to the distal end of the hose and has a push-pull valve (not shown) of known design for controlling the flow of water through the hose. A liquid crystal temperature indicator 38 is mounted on panel 12 to indicate the temperature of the water in the chamber.

A plurality of pockets or pouches for holding toiletries and other accessories for use by a bather are provided between the water chamber and the lower margin of panel 13. For that purpose, an additional sheet of flexible plastic material 39 is mounted on the back side of panel 13 and sealed to that panel along a horizontally extending line 41 beneath the chamber and along the side and lower margins 20, 42 of the panel. Sheet 39 can be fabricated of the same material as panel 12, e.g., transparent PVC having a thickness on the order of 15–20 mils.

Sheet 39 is also sealed to panel 13 along a pair of vertical lines 43, 44 which extend between weld line 41 and the weld line at the lower margin of the panel to form pockets 46, 47. Pocket 46 is of a relatively large size which is suitable for holding items such as a razor, toothpaste and other accessories, and pocket 47 is particularly suitable for holding shampoo.

Access to pocket 46 is provided by an opening formed by a horizontally extending cut 48 in sheet 39 just below weld line 41, and a snap fastener 49 releasably secures the sheet and the panel together to hold the pocket in a closed position and prevent items from falling out of the pocket. Ventilation for the items in the pocket is provided by a plurality of holes 51 in sheet 39.

Pocket 47 has a semicircular opening 52 formed by cutting away a portion of sheet 39 toward the top of the pocket. Another opening 53 is provided in the lower portion of the pocket for receiving the neck of a soap or shampoo container disposed in an invert ed position in the pocket. With the container in that position, the soap or shampoo can be dispensed from it without removing the container from the pocket. The opening for the neck is formed by a horizontally extending cut in sheet 39.

A mirror 57 is mounted in a lower corner of the body between weld line 44 and the side margin of panel 13. Sheet 39 And panel 13 are sealed together about the periphery of the mirror 58 to hold the mirror in place, and a portion of the sheet is cut away in front of the mirror to form a window 59 for the mirror.

Sheet 39 is also sealed to panel 13 along a horizontally extending line 60 above the mirror to form a pocket 61 for smaller items. An access opening for this pocket is formed by a horizontally extending cut 62 in sheet 39 toward the top of the pocket, and ventilation for items in the pocket is provided by holes 63 in the sheet.

Another sheet of transparent material 66 is affixed to the back side of panel 13 along weld lines 21, 27 and 28 and at the peripheral welds along the top and side margins 19, 20 of the panel. This sheet can be of the same material as sheet 39, e.g., 15–20 mil PVC. Horizontally extending pockets 67, 68 for items such as a toothbrush and comb are for med between sheet 66 and panel 13 to the sides of handhold opening 26. These pockets have semicircular access openings 69 which are formed by cutting away portions of sheet 66 toward the outer ends of the pockets. Ventilation for items in the pockets is provided by holes 71 in the sheet.

Markings 72 are printed on the rear surface of panel 13 in the various pockets to indicate the types of items which can be placed in them. Those markings are visible through the transparent sheets which form the front walls of the pockets Since the shower and accessory holder is fabricated of flexible materials except for the handle, it can be folded or rolled into a relatively small package which is light in weight and easily carried. In use, the chamber is filled with water, and the shower is placed in the sun with transparent panel 12 facing toward the sun. Items such as toiletries and other accessories can be placed in the pockets as desired so that they will be readily accessible to a bather when the shower is hung from a tree or other suitable support.

In the embodiment of FIGS. 1--3, the pockets are located on the back side of the body. This is advantageous in that the markings are easier to print on the lighter colored metallic layer at the back side of panel 13 than on the black layer at the front. However, if desired, the pockets can be formed on the front side of the body, in which case the transparent sheet which forms panel 12 can be extended and sealed to panel 13 to form the front walls of the pockets beneath the water chamber. With the pockets on the dark side of the body, the markings for the pocket contents are printed in a light color and are visible through panel 12.

Figure 4:
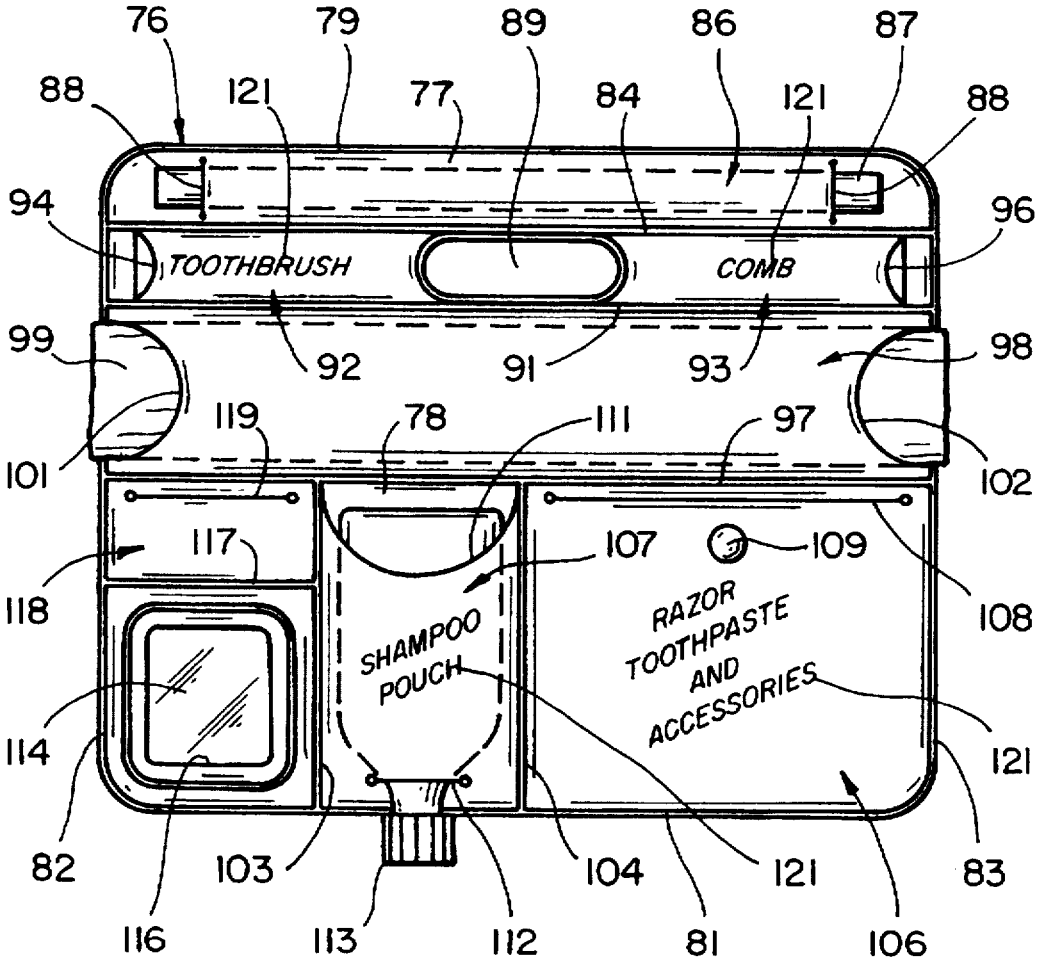
FIG. 4 is a front elevational view of another embodiment of an outdoor shower accessory holder according to the invention.

FIG. 4 illustrates an accessory holder which is intended for use with existing showers. This device comprises a generally rectangular body 76 formed by two superposed sheets or panels 77, 78 of flexible plastic material which are sealed together along their upper edges 79, lower edges 81 and side edges 82, 83. The sheets are fabricated of a material such as polyvinyl chloride (PVC) having a thickness on the order of 15–20 mils. In the embodiment illustrated, the front sheet is transparent, and the rear one is opaque.

The two sheets are sealed together along a line 84 spaced a short distance below the upper margins of the sheets to form a horizontally extending pocket 86 for receiving a tubular handle 87, as in the embodiment of FIGS. 1–3. Access to the pocket is provided by a pair of vertically extending cuts 88 in the front sheet near the side edges of the sheets. A handhold opening 89 is formed in the sheets beneath the pocket, and the sheets are sealed together about the periphery of the opening.

The sheets are also sealed together along a horizontally extending line 91 below the handhold opening to form a pair of relatively small, horizontally extending pockets 92, 93 beside the opening. Access to the pockets is provided by semicircular openings 94, 96 formed by cutting away portions of the front sheet toward the outer ends of the pockets. These pockets are suitable for holding items such as a toothbrush and a comb.

The sheets are sealed together along another horizontally extending line 97 which is spaced below line 91 to form a horizontally pocket 98 for holding a rolled-up bath mat 99. Access to this pocket is provided by semicircular openings 101, 102 formed by cutting away portions of the front sheet toward the outer ends of the pocket.

The two sheets are also sealed together along a pair of vertical lines 103, 104 which extend between weld line 97 and the weld line at the lower edge of the sheets to form a relatively large pocket 106 and a shampoo pocket or pouch 107. Access to pocket 106 is provided by a horizontally extending cut 108 in front sheet 77 toward the top of the pocket, and a snap fastener 109 positioned below the cut holds the sheets together to close the pocket. The shampoo pouch has a semicircular opening 111 at the top, and toward the bottom it has a slotted opening 112 for receiving the neck portion of an inverted bottle or container 113.

A mirror 114 is mounted in a lower corner of the body between weld lines 82 and 103. The two sheets are sealed together about the periphery of the mirror to hold the mirror in place, and a portion of the sheet is cut away in front of the mirror to form a window 116 for it.

The two sheets are also sealed together along a horizontally extending line 117 above the mirror to form a pocket 118 for smaller items. An access opening for this pocket is formed by a horizontally extending cut 119 in front sheet 77 toward the top of the pocket.

As in the embodiment of FIGS. 1–3, ventilation for items stored in the pockets is provided by vent holes (not shown) in front sheet 77, and markings 121 are printed on the front surface of rear sheet 78 in the various pockets to indicate the types of items which can be placed in them. Those markings are visible through the transparent sheet 77 which forms the front walls of the pockets.

As in the case of the embodiment of FIGS. 1–3, the accessory holder can be folded or rolled into a relatively small package which is light in weight and easily carried. In use, the holder is hung from a tree or other suitable support, and items such as toiletries and other accessories are placed in the pockets as desired so that they will be readily accessible to a bather or other person using them.

It is apparent from the foregoing that a new and improved outdoor shower and accessory holder have been provided. While only certain presently preferred embodiments have been described in detail, as will be apparent to those familiar with the art, certain changes and modifications can be made without departing from the scope of the invention as defined by the following claims.

I claim:

1. In a portable shower and accessory holder for outdoor use: first and second panels of flexible plastic material sealed together to form a chamber for holding water to be heated by solar energy, a flexible hose communicating with the chamber for delivering water from the chamber to a bather, and a sheet of flexible plastic material bonded to one of the panels alone lateral margins of the sheet and along a plurality of spaced apart lines between the lateral margins to form a plurality of pockets for holding accessory items for use by the bather.

2. The portable shower and accessory holder of claim 1 wherein one of the panels comprises a sheet of transparent material, and the other panel is a three layer structure comprising a dark colored inner layer which faces the chamber and absorbs solar energy, an outer layer which is reflective to solar energy, and a layer of insulative foam positioned between the inner and outer layers.

3. The portable shower and accessory holder of claim 1 wherein the sheet of flexible plastic material is transparent.

4. The portable shower and accessory holder of claim 1 including a snap mounted on the sheet and on the panel for holding one of the pockets in a closed position.

5. The portable shower and accessory holder of claim 1 including a mirror mounted between the sheet and the panel to which the sheet is bonded, with the sheet and the panel being bonded together about the periphery of the mirror, and a portion of the sheet being cut away in front of the mirror to form a window for the mirror.

6. The portable shower and accessory holder of claim 1 wherein the shower and accessory holder is adapted to be supported in an upright position with the hose communicating with a lower portion of the chamber and the pockets positioned beneath the chamber.

7. The portable shower and accessory holder of claim 6 wherein a handhold opening is formed in the panels above the chamber and an additional pair of pockets are positioned beside the handhold opening.

8. In a portable shower and accessory holder for outdoor use: first and second panels of flexible elastic material sealed together to form a chamber for holding water to be heated by solar energy, a flexible hose communicating with the chamber for delivering water from the chamber to a bather, a plurality of pockets on one of the panels for holding accessory items for use by the bather an opening in a lower portion of one of the pockets, and a soap/shampoo container disposed in the pocket with a neck portion of the container extending through the opening.

9. In a portable shower and accessory holder for outdoor use: first and second panels of flexible plastic material sealed together to form a chamber in a central region thereof for holding water to be heated by solar energy, a flexible hose communicating with a lower portion of the chamber for delivering water from the chamber to a bather, a horizontally extending handle attached to the panels above the chamber for use in carrying the shower and accessory holder and hanging the shower and accessory holder from a support, an opening in the panels beneath the handle for receiving the fingers of a hand gripping the handle, a pocket on each side of the opening for holding accessories for use by the bather, and a plurality of pockets beneath the chamber for holding additional items for use by the bather.

10. The portable shower and accessory holder of claim 9 including a mirror mounted on one of the panels adjacent to one of the pockets.

* * * * *